United States Patent [19]

Selfridge

[11] 4,041,605

[45] Aug. 16, 1977

[54] WALLPAPER TRIMMER

[75] Inventor: Leroy K. Selfridge, Vista, Calif.

[73] Assignee: Eugene W. Selfridge, Portland, Oreg.

[21] Appl. No.: 704,500

[22] Filed: July 12, 1976

[51] Int. Cl.[2] ..... B26B 29/00

[52] U.S. Cl. ..... 30/293; 30/294

[58] Field of Search ..... 30/293, 294, 290, 289, 30/286

[56] References Cited

U.S. PATENT DOCUMENTS

| | | | |
|---|---|---|---|
| 1,574,641 | 2/1926 | Christopherson | 30/293 |
| 1,863,153 | 6/1932 | Christopherson | 30/293 |
| 2,109,686 | 3/1938 | Breidenbach | 30/286 |
| 2,676,405 | 4/1954 | Schierghofer | 30/293 |
| 2,677,180 | 5/1954 | Schierghofer | 30/293 X |
| 2,853,778 | 9/1958 | Pratt et al. | 30/294 |
| 3,009,246 | 11/1961 | Witherby | 30/286 X |
| 3,349,486 | 10/1967 | Voight | 30/294 |
| 3,500,540 | 3/1970 | Lundquist | 30/294 |
| 3,504,435 | 4/1970 | Sloboda et al. | 30/293 |

*Primary Examiner*—James L. Jones, Jr.

*Assistant Examiner*—J. T. Zatarga

*Attorney, Agent, or Firm*—Chernoff & Vilhauer

[57] ABSTRACT

A hand-held wallpaper trimming tool which facilitates accurate and precise cutting of wallpaper along a joint between a wall being papered and an adjacent structural member. A guide portion is provided with a conical body member for resting against the adjacent structural member and gradually feeding the wallpaper into the joint, and with a flat flange attached at one edge tangentially to the body member for placement against the wall being papered and pressing the paper smoothly against that wall. A selectably extensible cutting blade, such as a single-edge injector razor blade, is mounted in a receptacle at the apex end of the body member and secured by a releasable fastener. The blade is oriented at an angle to the flange with its cutting edge facing in the direction of the plane of the flange. An elongate handle, projecting away from the body member and away from the flange is mounted at the base end of the body member for manipulating the device.

6 Claims, 3 Drawing Figures

WALLPAPER TRIMMER

BACKGROUND OF THE INVENTION

This invention relates to hand-held tools for trimming the edge of wallpaper during attachment of the wallpaper to a wall.

In the hanging of wallpaper, that is, attaching strips of wallpaper to a wall, it is usually desirable to terminate the wallpaper strips precisely where the wall to which the strips are attached joins an adjacent structural member such as another wall, ceiling molding, floor baseboard or the like, so that there is no gap showing on the papered wall between the ends of the wallpaper strips and the aforementioned joint, or overlap of wallpaper onto the adjacent structural member, which would otherwise produce a disorderly and sloppy appearance. Ordinarily, this is accomplished by cutting the wallpaper strips to a length slightly greater than the distance they are to cover, pasting the strips to the wall and trimming their ends along a line produced by the joint between the papered wall and the adjacent structural member. Wallpaper is hung this way because the respective borders along which two opposing ends of a strip of wallpaper are to terminate typically are not spaced apart a consistent distance or precisely parallel to one another, and it is easy to make a slight, but significant, error in the length of the paper when measuring over a relatively great distance, such as about eight feet. Also, in many cases it is necessary to match the pattern on one strip of wallpaper with the pattern on an adjacent strip, and applying a strip of wallpaper which is slightly longer than necessary permits adjusting its position as it is attached thereby facilitating the proper matching of the patterns.

The aforedescribed trimming aspect of hanging wallpaper is a particularly difficult, laborious and time consuming task which sometimes results in unsightly errors and increases the cost of having wallpaper hung professionally. Consequently, numerous tools have been designed in an attempt to alleviate the difficulties encountered in trimming wallpaper edges. For example, Stanley U.S. Pat. No. 2,473,551 discloses a wallpaper trimmer having an elongate handle with a razor blade holder attached to one end. However, the Stanley trimmer provides no means for ensuring that the wallpaper is cut at precisely the right point. Scholl U.S. Pat. No. 3,724,010 also shows a hand-held wallpaper-trimming tool having a blade holder, a smoothing blade for guiding the wallpaper into place and a pair of guides disposed along respective edges of the smoothing blade to ensure that the cutting edge of the blade attacks the wallpaper at an angle to the wall on which it is placed, thereby preventing the production of a gap along the papered wall or overlap on the adjacent structural member due to the thickness of the cutting blade. While this design would seem to provide some advantages in trimming wallpaper, its shape would render cumbersome the positioning of the tool against a structural member adjacent the wall being papered and, due to the width of the guides relative to the length of the tool handle, substantial leverage is produced which could cause tipping of the tool during use, resulting in inaccurate cutting.

Another relevant wallpaper trimmer, disclosed in Voight U.S. Pat. No. 3,349,486, utilizes a pair of guide plates joined together at right angles to fit into the corner of a pair of perpendicular walls and a cutting blade which protrudes through the joint of the two guides to cut at a 45° angle from both walls. Although this device would facilitate trimming wallpaper at the joint between two perpendicular walls, it would be considerably less useful where the adjoining wall is not perpendicular on the wallpaper is to be trimmed along an adjacent structural member having a nonlinearly shaped edge, for example, rounded molding. In addition, no means is provided for gradually guiding the wallpaper from a wide curve into a sharp corner at the joint where it is to be trimmed. Ring U.S. Pat. No. 799,675 also shows a wallpaper cutting tool having a guide for positioning a cutting blade relative to a flat surface but, due to the obtuse angle between the blade and the guide, and to blade fastening hardware which protrudes outwardly from the plane of the blade, the tool would not be suitable for trimming wallpaper at many types of joints between a wall and an adjacent structural member, particularly where a perpendicular corner exists.

Accordingly, there is a need for a wallpaper trimming tool which facilitates the trimming of wallpaper as it is hung such that the trimming may be accomplished with greater ease and precision, thereby reducing the time consumed in accomplishing trimming and reducing unsightly errors such as gaps along the papered wall and overlaps on an adjacent structural member. It would be desirable to provide such a device which positions a cutting blade precisely at the joint between the wall being papered and the adjacent structural member, and at an angle to the surface of the wall being papered. The tool also should be adapted to cut accurately and precisely at a variety of joints such as perpendicular walls, rounded molding adjoining a wall, or baseboard adjoining a wall. At the same time, such a device should smoothly guide the wallpaper gradually into the cutting joint to minimize any damage due to tearing or creasing.

SUMMARY OF THE INVENTION

The present invention reduces the aforedescribed difficulties in trimming the ends of wallpaper as it is applied to a wall, overcomes the drawbacks of prior art trimming devices and meets the need for a more effective trimming device by providing a hand-held cutting tool having a geometry which ensures the proper positioning of its wallpaper trimming blade, is particularly adapted to fit into a variety of joints, and serves to draw wallpaper gradually into position in a joint for cutting.

The principal part of the trimming tool of the present invention comprises a guide portion having a conical body member and a flat flange attached along one edge to the body member tangential to its conical surface such that the flange projects away from the edge where it is attached. The apex end of the conical body member, to which a cutting blade is attached, is designed to be drawn accurately along the joint line at which the wallpaper is to be cut, the base of the conical member facing in the direction of movement of the tool, with the result that the uncut wallpaper is drawn gradually and smoothly, that is, "focused", from a wide curve into the more sharply-curved joint where it is to be cut. Accurate positioning of the cutting blade is ensured due to the action of the flange, which rests against the wall being papered, and the outer conical surface of the body, which rests against the adjacent structural member, even where the adjoining structure is not perpendicular to the wall being papered or has a nonlinearly shaped edge such as molding, baseboard or the like.

Also, the flange serves to press the wallpaper smoothly against the wall as the paper is being cut.

A blade holder is attached to the guide member to accept a replaceable blade and position the blade at an angle to the wall being papered so that it cuts very nearly precisely at the joint of the outer surfaces of the wall and adjacent structural member, eliminating any gap or overlap otherwise produced by the width of the blade, and this angle is maintained by the flange which rests against the wall being papered. For convenience, the blade holder should accept a commonly available blade, such as a single-edge injector razor blade. The holder permits the distance which the blade projects outwardly to be adjustable, utilizing a finger-actuated fastener for readily tightening and releasing the blade.

In addition, the tool is provided with an elongate handle attached to the base end of the conical body member such that it projects in a direction away from the apex end of the body member, toward the direction of projection of the flange, and away from the flange, toward the direction of the body member, preferably between the plane of the flange and the plane of the blade. This permits the tool to be held comfortably and properly positioned with one hand. In conjunction with the handle, a finger rest is included near the apex of the body member for applying pressure at the forward end of the tool for stable positioning thereof and more effective cutting of the wallpaper.

Therefore it is a principal objective of the present invention to provide a new and improved wallpaper trimming device which facilitates accurate and precise cutting of wallpaper.

It is another principal objective of the present invention to provide such a wallpaper trimming device which guides a cutting blade accurately and precisely along a joint between a wall being papered and an adjacent structural member, is easy to hold and manipulate, and is adapted to a variety of different types of joints.

It is a further objective of the present invention to provide such a wallpaper trimming device which guides the wallpaper to be cut gradually and smoothly into position in a joint and presses the wallpaper smoothly against the wall being papered as it is being cut.

It is a particular feature of the present invention that it utilizes a guide portion having a conical body member and a flat guide flange attached tangentially along one edge thereof to the body member and projecting away therefrom, for positioning a cutting blade and guiding wallpaper into position for cutting.

It is another feature of the present invention that it utilizes a blade holder and a projecting blade mounted therein to attack the wallpaper at an angle to the wall being papered, and whose distance of projection from the body member may be adjusted.

It is a further feature of the present invention that it utilizes an elongate handle projecting away from the apex end of the body member, in the direction of projection of the flange, and away from the flange, in the direction of the body member, for manipulating the tool, and a finger rest adjacent the apex of the body member for effectuating stability and cutting of the wallpaper.

The foregoing objectives, features and advantages of the present invention will be more readily understood upon consideration of the following detailed description of the invention taken in conjunction with the accompanying drawings.

DETAILED DESCRIPTION OF THE INVENTION

Figure 1:
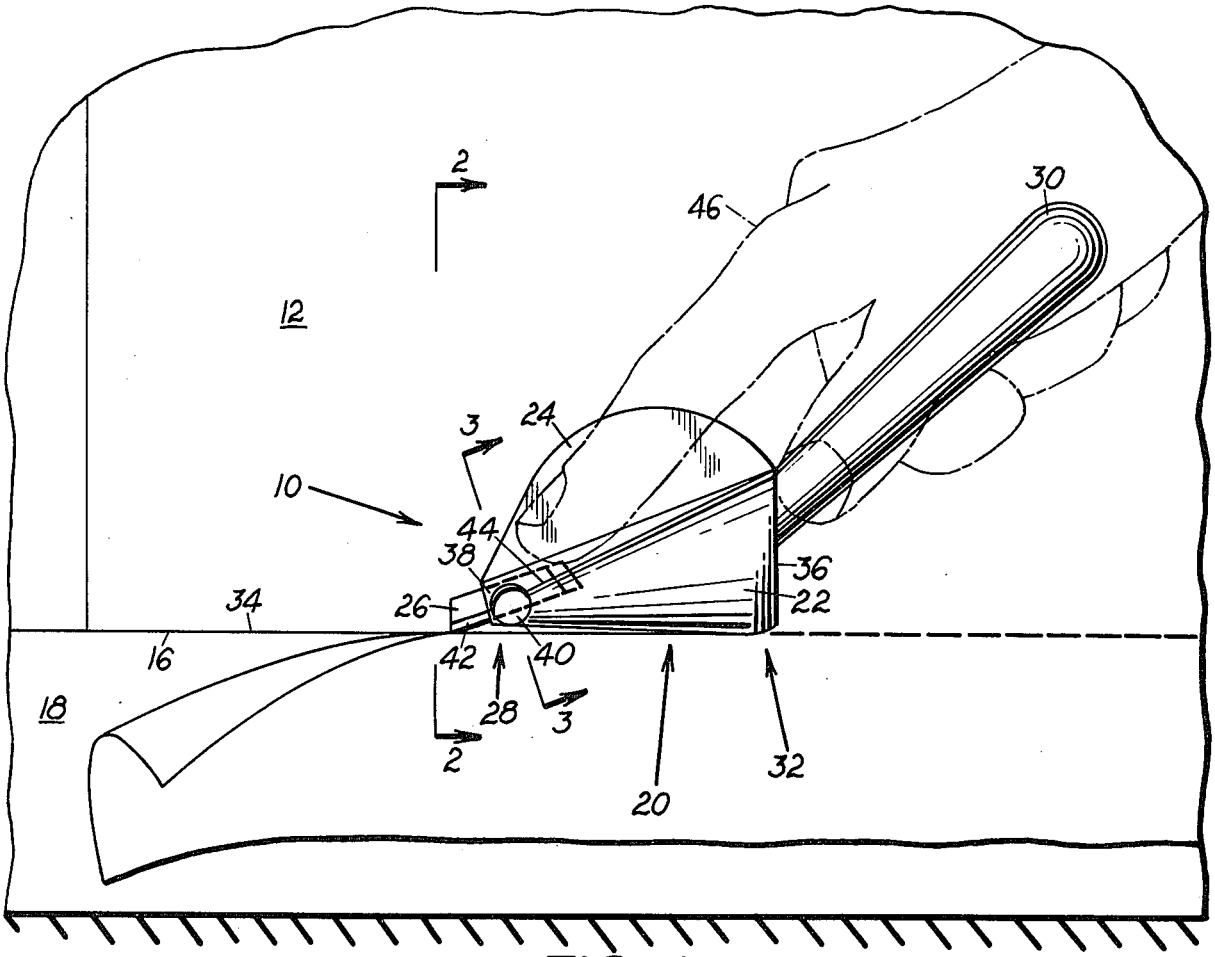
FIG. 1 is a side elevation of the wallpaper trimming device of the present invention showing a portion of wallpaper being trimmed and, in phantom, a user's hand.
Figure 2:
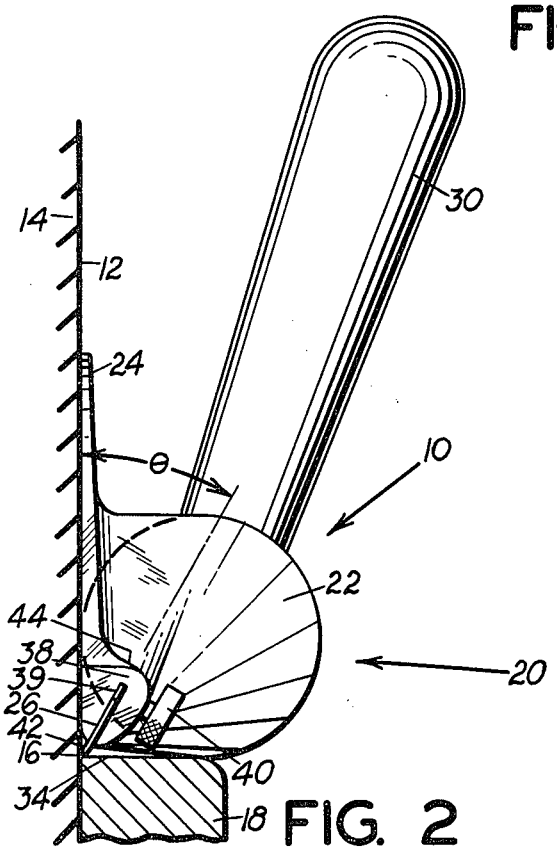
FIG. 2 is an end view of the wallpaper trimmer taken along line 2—2 of FIG. 1.

Referring to FIGS. 1 and 2, the wallpaper trimming tool 10 of the present invention is shown in use cutting the edge of a strip of wallpaper 12 being applied to a wall 14 along the outer surface joint 16 between the wall and a baseboard 18. The tool 10, comprises a guide portion 20 having a body member 22 with a conical outer surface for positioning the tool and guiding the wallpaper, and a flat flange 24 attached along one edge thereof tangentially to the body member and projecting away therefrom, also for positioning the tool and for pressing the wallpaper against the wall as it is cut. A cutting blade 26 is disposed adjacent the apex end 28 of the body member for cutting the wallpaper and an elongate handle 30 is attached to the base end 32 of the body member for manipulating the tool.

Proper positioning of the tool, and hence the cutting blade 26, in a joint between the wall to be papered and an adjacent structural member is accomplished by placement of the flange 24 against the wall, with the wallpaper sandwiched therebetween and by resting the side of the body member opposite the direction of projection of the flange against the adjacent structural member, such as a baseboard 18 having a linear edge 34 as shown in FIGS. 1 and 2. This provides unidirectional position references in two dimensions so that, by forcing the tool against these two references, the position of the cutting blade will be stabilized, resulting in accurate cutting. Likewise, the tool may be used in an identical manner at the joint between a wall to be papered and another wall. The same applies as well where the adjacent structural member does not provide a linear edge 34 perpendicular to the wall 14 to be papered, as is shown in the drawings, but where a rounded molding is utilized, or where two walls are joined at other than a 90° angle. In such cases the conical surface of the body member 22 may be moved one way or the other in the dimension of the plane of the wall until it comes to rest against the adjacent structure, and the blade 26 is moved inwardly or outwardly so that it strikes the wallpaper precisely at the joint 16 under that condition.

The tool is utilized by pulling the apex end 28 of the body along the joint 16 at which the wallpaper is to be cut, in the direction of the base end 32 of the tool. This causes the uncut portion of wallpaper preceding the base end of the tool and having a widely-curved bend therein to be drawn gradually and smoothly, that is, to be focused, into a relatively sharply-curved joint for cutting, without producing any tearing or creasing of the wallpaper. Accordingly, the base end of the body member is provided with a rounded edge 36 to prevent snagging of the wallpaper. At the same time, since the flange 24 is being pressed against the wall, the apex end of the body member is also very close to the wall, while the portion of the base end closest to the joint is a distance away from the wall. Thus, the wallpaper is moved from a position a distance away from the wall, adjacent the base end of the body, to a position in contact with the wall, adjacent the apex end of the body, and is pressed securely against the wall by the flange 24.

Figure 3:
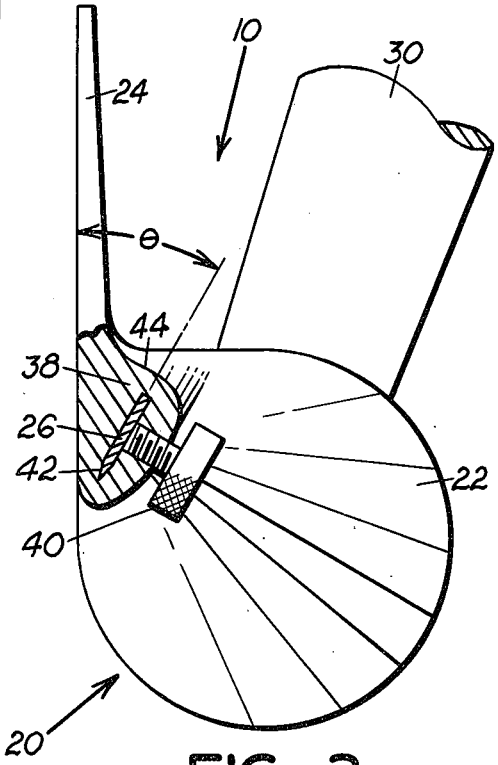
FIG. 3 is a section of the wallpaper trimmer taken along line 3—3 of FIG. 1.

A blade holder 38 is attached to the tool adjacent the apex end 28 of the body member for accepting the cutting blade 26. The holder preferably comprises a receptacle member integrally formed between the flange and body member having an elongate aperture 39 therein to receive the cutting blade so that it may move inwardly and outwardly relative to the body member for varying degrees of projection to compensate for different positioning of the body member. The blade may be secured by any appropriate fastening means, but it is preferred that a readily adjustable thumb screw 40 be utilized, as particularly shown in FIG. 3. The thumb screw is mounted in the receptacle perpendicular to the aperture 39 and easily tightens against the side of the blade in response to a slight twist, thereby preventing movement of the blade, and vice-versa to release the blade. Whily many different types of blades might be utilized with varying degrees of success, it is preferred that the blade holder be designed to accept a commonly used injector-type razor blade since these are readily available and are sufficiently sharp to cut wallpaper.

It is particularly significant that the blade 26 is mounted at an angle $\theta$ to the plane of the flange 24 so that the sharp edge 42 of the blade faces in a direction running from the body member side of the flange angled toward the plane of the flange, thereby attacking the wallpaper more nearly at the precise point of meeting between the outside surfaces of the wall and adjacent structural member than could be accomplished if the blade attacked either parallel to the wallpaper, which would cause a slight overlap of wallpaper onto the adjacent structure, or perpendicular to the wall, which would cause a slight gap between the edge of the wallpaper and the adjacent structure, due to the thickness of the blade.

The handle 30 of the cutting tool, which is attached to the base end 32 of the body member, should preferably extend away from the guide portion in a direction away from the apex end and toward the direction of projection of the flange 24. In addition, the handle should extend away from the plane of the flange 24 toward the direction of the body member 22 so that it is askew thereto. Preferably, the handle should be positioned between the plane of the flange 24 and the plane of the blade 26. While a variety of positions of the handle might be found comfortable, it has been determined that the foregoing characteristics provide the most comfortable manipulation of the tool.

In conjunction with the handle, a finger rest 44, preferably formed by the surface of the blade holder 38 between the flange and the body member, is provided adjacent the apex end of the body so that an individual using the tool may apply force to the apex end of the tool utilizing, ordinarily, his index finger, as shown by the hand 46 in FIG. 1. Force applied by the user's finger increases the position stability of the tool and its cutting effectiveness as well. While the hand 46 shown is a right-hand, it should be recognized that the tool, as shown, might be utilized by a left-handed individual and, more importantly, that a left-handed tool of mirror-image design could also be built, i.e. with the position of the flange and blade holding mechanism reversed to the opposite side of the body member 22, to produce a more comfortable tool for a left-handed user.

The trimming tool 10 may be made of metal, plastic, or any convenient combination of those, or other, materials as long as it has sufficient strength to withstand the force necessary for cutting. If a moldable material is used, most of the parts, i.e. the body member 22, the flange 24, the handle 30, the blade holder 38 and the finger rest 44 could all be integrated into a single molded structure.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A wallpaper trimming device for cutting wallpaper at a joint between a wall being papered and an adjacent structural member, said trimming device comprising:

a. a body member for positioning said trimming device against said adjacent structural member and guiding said wallpaper gradually into said joint, and body member having a base end, an apex end and a conical outer surface, said body member providing a first position reference when placed with said conical outer surface resting upon said adjacent structural member, said apex end proximate the line of said joint and said base end spaced away from said wall;

b. a substantially flat flange attached along one edge thereof to said body member such that the plane of said flange is substantially tangent to said conical outer surface of said body member, said flange extending outwardly therefrom, for positioning said trimming device against said wall being papered and pressing said wallpaper against said wall, said flange providing a second position reference when placed against said wall with said wallpaper sandwiched therebetween while said conical surface of said body member is resting upon said adjacent structural member;

c. a handle attached to said base end of said body member for moving said body member and said flange along said adjacent structural member and said wall, respectively, relative to said first and second position references and in a direction generally from said apex end toward said base end of said body member; and d. a cutting member attached to said body member at said apex end intermediate said body member and said flange for cutting said wallpaper at said joint, said cutting member comprising a blade having a cutting edge along one side, said blade being mounted on the same side of said flange as said body member at an angle from said flange in the direction of said body member and extending therefrom such as to have said cutting edge closely proximate said joint when said body member and said flange are positioned against said adjacent structure and said wall, respectively.

2. The trimming device of claim 1 wherein said handle is elongate in shape, and projects away from said body member in a direction generally toward the direction of extension of said flange, away from said apex end and askew to the plane of said flange.

3. The trimming device of claim 1 wherein said cutting member comprises an elongate blade extensible away from said apex end in a direction running from said base end of said body member toward said apex end, and means for extensibly holding said blade.

4. The trimming device of claim 3 wherein said means for holding said blade comprises a receptacle having an elongate aperture and a thumb screw disposed therein perpendicular to said aperture for releasable engagement with said blade.

5. The trimming device of claim 1 wherein said base end of said body member has a rounded edge where it joins with said conical outer surface.

6. The trimming device of claim 1 further comprising finger rest means disposed between said projecting flange and said body member adjacent said apex end thereof, for receiving a user's finger to apply pressure to said apex end.

* * * * *

UNITED STATES PATENT AND TRADEMARK OFFICE

CERTIFICATE OF CORRECTION

PATENT NO. : 4,041,605

DATED : August 16, 1977

INVENTOR(S) : Leroy K. Selfridge

It is certified that error appears in the above-identified patent and that said Letters Patent are hereby corrected as shown below:

| | |
|---|---|
| Col. 1, Line 6 | Change "edge" to --edges--. |
| Col. 2, Line 6 | Change "on" to --or--. |
| Col. 5, Line 20 | Change "whily" to --while--. |
| Col. 6, Line 23 | After "joint," delete "and" and substitute --said--. |

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*